US008113804B2

(12) United States Patent
Heitz et al.

(10) Patent No.: US 8,113,804 B2
(45) Date of Patent: Feb. 14, 2012

(54) VANE PUMP WITH ROTATING CAM RING AND INCREASED UNDER VANE PRESSURE

(75) Inventors: Steven A. Heitz, Rockford, IL (US); Christian L. Griffiths, Belvidere, IL (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 491 days.

(21) Appl. No.: 12/345,713

(22) Filed: Dec. 30, 2008

(65) Prior Publication Data

US 2010/0166588 A1 Jul. 1, 2010

(51) Int. Cl.
*F04C 2/00* (2006.01)
*F04C 29/00* (2006.01)

(52) U.S. Cl. ..... 418/82; 418/29; 418/260; 418/268

(58) Field of Classification Search ..... 418/24–28, 418/74, 75, 76, 82, 259, 266–268, 260, 262, 418/29

See application file for complete search history.

(56) References Cited

U.S. PATENT DOCUMENTS

| | | | | | |
|---|---|---|---|---|---|
| 2,255,784 | A | * | 9/1941 | Kendrick | 418/82 |
| 2,255,785 | A | * | 9/1941 | Kendrick | 418/82 |
| 2,256,459 | A | * | 9/1941 | Kendrick | 418/82 |
| 2,815,647 | A | * | 12/1957 | Albrecht et al. | 418/29 |
| 3,016,017 | A | | 1/1962 | Prendergast | |
| 3,153,384 | A | | 10/1964 | Castle | |
| 3,437,079 | A | * | 4/1969 | Odawara | 418/111 |
| 3,455,245 | A | | 7/1969 | Reichling | |
| 3,762,843 | A | * | 10/1973 | Suzuki et al. | 418/80 |
| 4,406,599 | A | | 9/1983 | Stephan | |
| 4,445,830 | A | | 5/1984 | Woodruff | |
| 4,492,545 | A | | 1/1985 | Mochizuki | |
| 4,659,296 | A | | 4/1987 | Bristow | |
| 4,659,297 | A | | 4/1987 | Kahrs | |
| 5,456,574 | A | | 10/1995 | Donnelly | |
| 5,715,674 | A | | 2/1998 | Reuter | |
| 5,961,307 | A | * | 10/1999 | Key et al. | 418/82 |
| 7,094,042 | B1 | | 8/2006 | Borgetti | |
| 7,165,949 | B2 | | 1/2007 | Firnhaber | |
| 2006/0039816 | A1 | | 2/2006 | Cygnor | |
| 2009/0142215 | A1 | * | 6/2009 | Cygnor | 418/225 |

* cited by examiner

*Primary Examiner* — Theresa Trieu
(74) *Attorney, Agent, or Firm* — Carlson, Gaskey & Olds, PC

(57) ABSTRACT

An example vane pump comprises a shaft driving a rotor. The rotor has a plurality of vane grooves, with a vane received in each of the plurality of vane grooves, and an under vane chamber for communicating a pressurized fluid into the grooves to bias the vanes radially outwardly of the rotor. A cam ring is positioned radially outwardly of the rotor. The cam ring is free to rotate with the rotor through friction from the vanes as the rotor rotates. An inlet delivers a fluid to be pumped into an inlet chamber, and an outlet receives the fluid pumped by the vane pump. An outlet for the fluid biasing the vanes communicates to a main outlet through a passage including a valve to increase the pressure of the fluid in the grooves.

9 Claims, 2 Drawing Sheets

VANE PUMP WITH ROTATING CAM RING AND INCREASED UNDER VANE PRESSURE

BACKGROUND OF THE INVENTION

This application relates to a vane pump wherein a cam ring rotates with the vanes, and wherein an under vane pressure is provided with structure to increase the force holding the vane against the cam ring.

Vane pumps are known, and typically include a rotor driven to rotate. The rotor carries a plurality of vanes that are biased outwardly of under vane slots, and against an inner periphery of a cam ring. As the rotor rotates, fluid in chambers between the vanes is moved from an inlet toward an outlet.

One type of vane pump has a rotating cam ring. The cam ring is caused to rotate with the vanes, typically by a frictional contact between the vane and the cam ring. This type of vane pump raises challenges, in that it is sometimes difficult to ensure the cam ring rotates at a sufficient speed.

It is known in vane pumps to provide an under vane pressure to hold the vane outwardly against the inner periphery of the cam ring. However, this has not always proven sufficient to move the cam ring at the desired speed in a rotating cam vane pump.

In a balanced vane type of vane pump without the rotating cam ring, but rather a fixed cam ring, it is known to have an under vane pressure wherein a back pressure valve ensures the pressure in the under vane chamber is high. However, this concept has never been applied to a rotating cam vane pump.

SUMMARY OF THE INVENTION

An example vane pump comprises a shaft driving a rotor. The rotor has a plurality of vane slots, with a vane received in each of the plurality of vane slots, and an under vane chamber for communicating a pressurized fluid into the under vane slots to bias the vanes radially outwardly of the rotor. A cam ring is positioned radially outwardly of the rotor. The cam ring is supported by a bearing and is free to rotate with the rotor through friction from the vanes as the rotor rotates. An inlet delivers a fluid to be pumped into an inlet chamber, and an outlet receives the fluid pumped by the vane pump. An outlet for the fluid biasing the vanes communicates to a main outlet through a passage including a valve to increase the pressure of the fluid in the grooves.

These and other features of the present invention can be best understood from the following specification and drawings, the following of which is a brief description.

DETAILED DESCRIPTION OF THE PREFERRED EMBODIMENT

Figure 1:
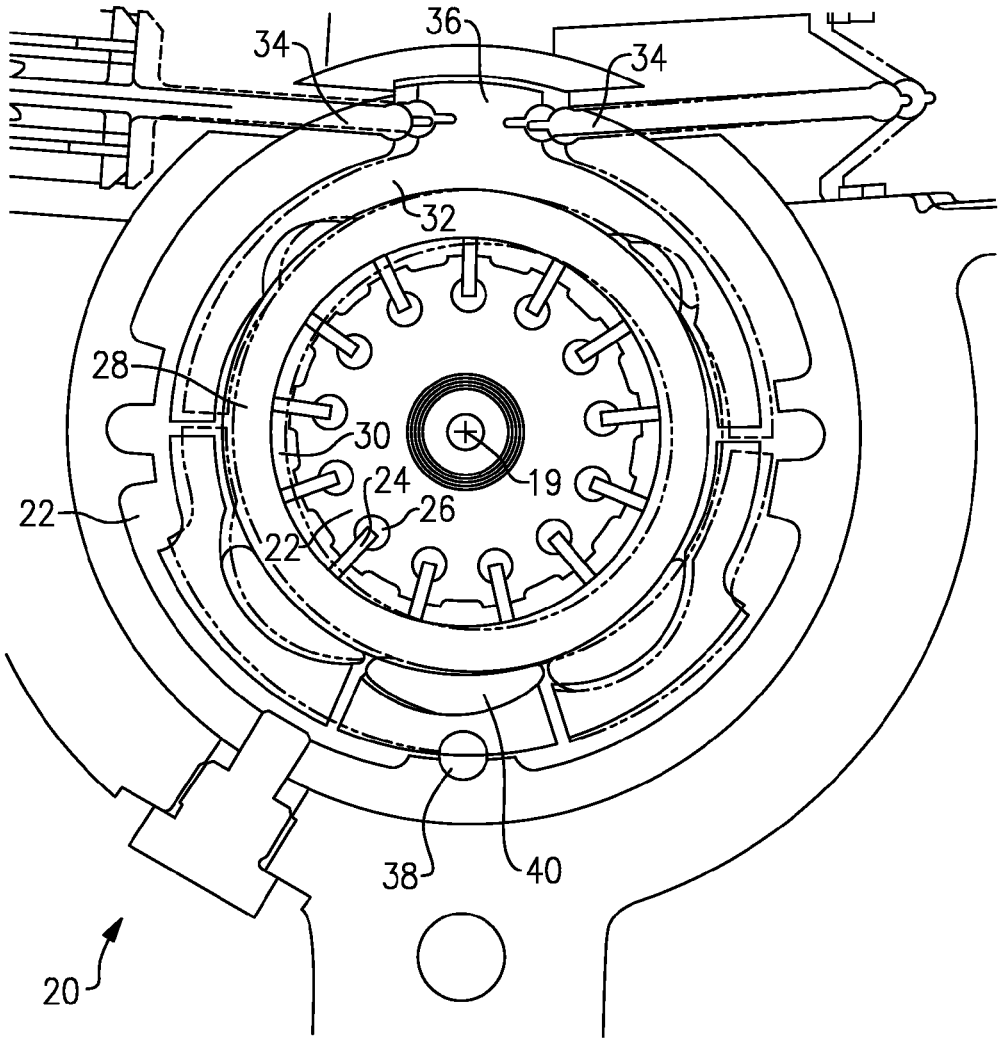
FIG. 1 is a front view of a vane pump.

FIG. 1 shows a vane pump 20 incorporating a rotor 22 driven to rotate by a shaft 19. The rotor 22 carries a plurality of vanes 24 that are movable within vane slots or grooves 26. A rotating cam ring 28 is caused to rotate with the vanes, and chambers 30 defined between the vanes carry a fluid from an inlet toward an outlet (not shown in this view).

A bearing support housing 32 surrounds a plurality of pivot bearings 40 although other types of fluid film or rolling element bearings may also be used to support the cam ring.

A fulcrum 36 receives actuators 34, and can cause the housing 32 to pivot about a pivot pin 38. As known, this changes the displacement volume of the vane pump 20 by changing the eccentricity between the cam ring 28 and the rotor 22. These features are all as known in the prior art. Further, while this invention is shown in a vane pump having the pivot bearings 40 and the pivoting bearing support, or housing 32, the invention would extend to any vane pump having a rotating cam ring.

Figure 2:
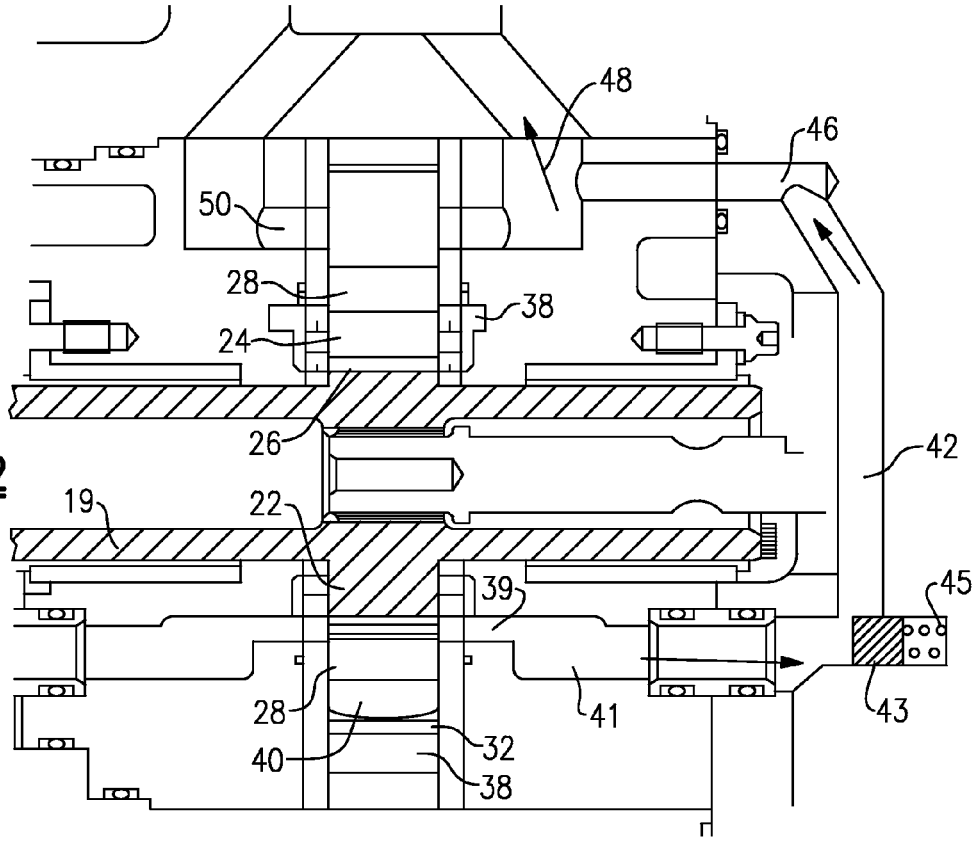
FIG. 2 is a cross-sectional view through the inventive vane pump.

As shown in FIG. 2, grooves 26 receive fluid at discharge pressure. This fluid communicates through passages 38 and 39 to a passage 41, a passage 42, into a passage 46, which communicates with a discharge line 48 for receiving the normal discharge from ports 50 delivered by the pump and the vanes 24

A valve 43 is positioned on the under vane return line 41, 42, and includes a spring bias 45. The under vane pressure will have to overcome the spring bias to move the valve 43 to the right as shown in FIG. 2 such that fluid can return from the line 41 to the line 42, and eventually back to the line 46 and the outlet 48. As is clear from FIG. 2, all fluid in the line 41 passes into the line 42 once it has opened the valve 43.

By placing the valve 43 on this line, the under vane pressure is increased relative to the discharge pressure. Thus, the force holding the vanes 24 outwardly against the inner periphery of the cam ring 28 is increased, and the friction and force between the two is increased such that the cam ring 28 is better able to be driven at the same speed as the vanes 24.

Higher under vane pressure is applied to selected vane slots to achieve the highest efficiency and durability. The rotor and vanes rotate about a center which is offset from the center of rotation of the cam ring. This results in relative motion between the vane tip and the cam ring. Only selected vanes at positions of lower sliding motion receive the increased under vane pressure. This approach yields a higher efficiency than other approaches to increase vane tip load such as utilizing heavier vanes.

Figure 3:
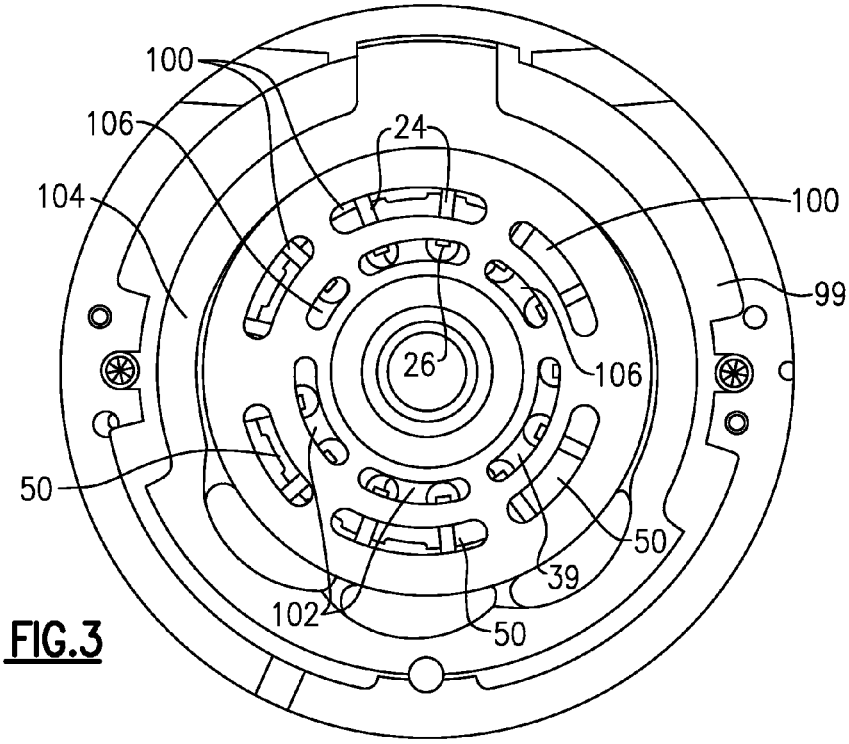
FIG. 3 shows porting details.

As shown in FIG. 3, the higher under vane pressure may be limited to an arc that begins at approximately 180° in the rotation of the cam, and near the end of the inlet arc, passing through the discharge arc. When the housing 32 pivots, the eccentricity of the rotor 22 can change relative to the cam ring 28. When this occurs, the forces between the vanes and the cam ring change across the circumference of the rotor. Also, the relative velocities between the vane tips and the cam ring vary. In the quadrant wherein the discharge arc is just beginning, the vanes are seeing the highest forces, and the under vane pressure may be most valuable. Thus, the higher under vane pressure may be limited to the slots under only a few vanes. In addition, the under vane pressure may be undesirable at other locations, such as the beginning of the inlet arc. As such, a designer may choose to control the portion of the arc in which the under vane pressure is applied.

In FIG. 3, the port plate 99 is illustrated. The vanes 24 can be seen further into the plane of the figure. Radially outer inlet ports 100 communicate with the area radially outwardly of the rotor, and define an inlet arc for the pump. In that same area, under vane ports 106 deliver pump fluid to the grooves 26. A seal arc 104 is positioned between the inlet arc and a discharge arc. In the discharge arc, the chambers outwardly of the rotor communicate with ports 50 to move the pump fluid to discharge. Under vane ports 102 supply under vane pump fluid. As mentioned above, should it be desired to limit the arc that receives the higher pressure, then only one of the ports, port 39 for example, would communicate through the valve 43 to the general discharge. The ports 102 would go through separate paths to the main discharge, and in this way, the higher pressure would only exist for the vanes aligned with the single under vane port 39.

While hydrostatic tilting bearings are shown, other ways of providing support, such as a hydrodynamic or hydrodynamic film bearing in addition to the rolling element bearing may be utilized.

Finally, controls may be included such that the increased under vane pressure may be limited to lower pump speeds.

Although an embodiment of this invention has been disclosed, a worker of ordinary skill in this art would recognize that certain modifications would come within the scope of this invention. For that reason, the following claims should be studied to determine the true scope and content of this invention.

What is claimed is:

1. A vane pump comprising:

a shaft driving a rotor, said rotor having a plurality of vane grooves, with a vane received in each of said plurality of vane grooves, and an under vane passage for communicating a pressurized fluid into said grooves to bias said vanes radially outwardly of said rotor;

a cam ring positioned radially outwardly of said rotor, and said cam ring being free to rotate with said rotor through friction from said vanes as said rotor rotates;

an inlet for delivering a fluid to be pumped into an inlet chamber, and a main outlet for receiving the fluid pumped by the vane pump; and an under vane outlet for the fluid in said grooves, said under vane outlet communicating to said main outlet through a passage including a valve to increase the pressure of the fluid in the grooves.

2. The vane pump as set forth in claim 1, wherein said vane pump includes a pivoting housing structure for changing the displacement of the vane pump.

3. The vane pump as set forth in claim 1, wherein said valve is positioned at an intersection of a first and second passage, and the fluid returning from the grooves must open the valve against a spring bias to pass from the first passage into the second passage.

4. The vane pump as set forth in claim 3, wherein all of the fluid in the first passage passes into the second passage once the valve has opened.

5. The vane pump as set forth in claim 1, wherein tilting pad bearings support the cam ring.

6. The vane pump as set forth in claim 1, wherein the grooves that communicate to the under vane outlet to have the increased pressure are limited to only a portion of said plurality of vane grooves.

7. The vane pump as set forth in claim 6, wherein the vanes that receive the increased pressure are those associated with the beginning of a discharge arc.

8. A vane pump comprising:

a shaft driving a rotor, said rotor having a plurality of vane grooves, with a vane received in each of said plurality of vane grooves, and an under vane passage for communicating a pressurized fluid into said grooves to bias said vanes radially outwardly of said rotor;

a cam ring positioned radially outwardly of said rotor, and said cam ring being free to rotate with said rotor through friction from said vanes as said rotor rotates;

an inlet for delivering a fluid to be pumped into an inlet chamber, and a main outlet for receiving the fluid pumped by the vane pump;

an under vane outlet for the fluid in said grooves, said under vane outlet communicating to said main outlet through a passage including a valve to increase the pressure of the fluid in the grooves;

said vane pump including a pivoting housing structure for changing the displacement of the vane pump;

said valve being positioned at an intersection of a first and second passage, and the fluid returning from the grooves must open the valve against a spring bias to pass from the first passage into the second passage; and the grooves that communicate to the under vane outlet to have the increased pressure being limited to only a portion of said plurality of vane grooves, the vanes that receive the increased pressure being those associated with the beginning of a discharge arc.

9. The vane pump as set forth in claim 8, wherein all of the fluid in the first passage passes into the second passage once the valve has opened.

* * * * *